United States Patent [19]

Ushijima et al.

[11] 4,335,078

[45] Jun. 15, 1982

[54] CATALYTIC REACTOR FOR AUTOMOTIVE EXHAUST LINE

[75] Inventors: Takashi Ushijima, Tokyo; Hajime Kawasaki, Yokohama; Takayuki Yamazaki, Tokyo; Yoshio Iwasa, Nagareyama, all of Japan

[73] Assignee: Nissan Motor Company, Limited, Yokohama, Japan

[21] Appl. No.: 123,572

[22] Filed: Feb. 22, 1980

Related U.S. Application Data

[63] Continuation of Ser. No. 919,791, Jun. 28, 1978, abandoned.

[30] Foreign Application Priority Data

Sep. 13, 1977 [JP] Japan ..... 52-122411[U]
Oct. 11, 1977 [JP] Japan ..... 52-135155[U]

[51] Int. Cl.[3] ..... F01N 3/28; B01J 35/04

[52] U.S. Cl. ..... 422/179; 29/157 R; 422/180

[58] Field of Search ..... 422/171, 170, 177, 179, 422/180; 60/299, 301; 181/257, 258, 268; 29/157 R

[56] References Cited

U.S. PATENT DOCUMENTS

| | | | |
|---|---|---|---|
| 3,692,497 | 9/1972 | Keith et al. | 422/179 |
| 3,854,888 | 12/1974 | Frietzsche et al. | 422/171 |
| 3,912,459 | 10/1975 | Kearsley | 422/179 |
| 3,938,232 | 2/1976 | Noda et al. | 422/117 |
| 4,020,539 | 5/1977 | Vroman | 422/180 X |
| 4,049,388 | 9/1977 | Scheitlin et al. | 422/171 |
| 4,070,158 | 1/1978 | Siebels | 422/180 |
| 4,126,421 | 11/1978 | Morikawa | 422/177 |
| 4,142,864 | 3/1979 | Rosynsky et al. | 422/179 |
| 4,143,117 | 3/1979 | Gaysert | 422/119 |

FOREIGN PATENT DOCUMENTS

| | | | |
|---|---|---|---|
| 2213539 | 10/1973 | Fed. Rep. of Germany | 422/177 |
| 2364425 | 7/1975 | Fed. Rep. of Germany | 422/177 |
| 2400443 | 7/1975 | Fed. Rep. of Germany | 422/171 |
| 2525661 | 12/1975 | Fed. Rep. of Germany | 422/179 |
| 1437315 | 5/1976 | United Kingdom | 422/177 |

*Primary Examiner*—Michael S. Marcus

[57] ABSTRACT

A catalytic reactor confining a catalyst in a mid-portion of a tubular housing made up of a pair of shells flanged sideways and welded together. The cross-sectional area of the housing becomes largest in the mid-portion, and the assembled shells define therein a fore-portion diverging towards the mid-portion and an aft-portion converging from the mid-portion. Side flanges of each shell are formed substantially over the entire length of the shell, and the width of the flanges is enlarged in both the fore- and aft-portions. The housing has two coupling flanges welded respectively at the fore- and aft-ends of the housing both to the outer periphery of the shells and to the ends of the side flanges. When the reactor confines therein a porous monolithic core shaped similarly to the mid-portion of the housing and treated with a catalyst, a buffer layer of wire mesh covers the periphery of the core so as to be tightly interposed between the core and the inner surfaces of the assembled shells, and marginal regions of the buffer layer are made to protrude beyond the end faces of the core so as to be forcibly folded inwards during assemblage of the reactor by two peripheral shoulders formed on the inside of the shells at fore- and aft-boundaries of the mid-portion.

5 Claims, 6 Drawing Figures

CATALYTIC REACTOR FOR AUTOMOTIVE EXHAUST LINE

This is a continuation of application Ser. No. 919,791, filed June 28, 1978, abandoned.

BACKGROUND OF THE INVENTION

This invention relates to a catalytic reactor for use in automotive engine exhaust lines and of the type having a tubular housing which confines therein a catalyst preferably carried on a monolithic core.

Catalytic converters or reactors are now in wide use in automotive engine exhaust lines with the purpose of converting carbon monoxide, hydrocarbons and/or nitrogen oxides contained in the engine exhaust gas into harmless substances. In many cases a catalytic reactor for this purpose utilizes a monolithic carrier or core which is treated with a catalyst and has a cylindrical shape in a broad sense and a structure adapted for a generally axial gas flow therethrough. A typical example is a core of honeycomb structure having a generally elliptical cross-sectional shape. A major portion of a reactor housing to confine therein such a catalytic core is made up of a pair of shells flanged sideways and joined together along a plane containing the longitudinal axis of the housing. This major portion of the reactor housing has a larger cross-sectional area than exhaust pipes and is almost entirely occupied by the catalytic core. The housing, therefore, makes this portion as its mid-portion and has a foreportion through which exhaust gas is introduced into the mid-portion and an aft-portion through which the treated exhaust gas is discharged. The fore- and aft-portions are required to have a sufficiently high rigidity since they must support the mass of the mid-portion including the core and obstruct the transmission of shocks and vibrations from other components of the exhaust system to the mid-portion. In many cases, the fore- and aft-portions each take the form of a relatively thick cylinder, with a coupling flange welded at one end thereof for coupling with exhaust pipe, and are welded to the mid-portion.

A reactor housing of this construction involves a problem that the respective weld joints between the mid-portions, i.e. an assembly of two shells made from a relatively thin plate (e.g. 1.0–1.5 mm), and the fore- and aft-portions of a larger wall thickness (e.g. 2.0–2.5 mm) are rather weak to shocks and vibrations and tend to become the origin of cracks in the shells. This problem may be solved by increasing the wall thickness of the shells, but in practice such countermeasure is quite undesirable because of increasing difficulties in the press-forming of the individual shells and welding of the two shells, increasing weight of the housing and increasing cost of the material (the housing must be made of a heat- and corrosion resistant alloy).

Besides, it is difficult to weld the side flanges of the mid-portion at their fore- and aft-ends to the cylindrical fore- and aft-portions of the housing with high strength or rigidity of the resultant joints.

Regarding the interior of the reactor, it is necessary that the catalyst-treated core is held immovable and isolated from the inner surfaces of the shells since the core is usually made of a ceramic material and hence is fragile. A prevailing method of meet this necessity is the provision of a cushioning or buffer layer around the outer periphery of the core so as to be tightly interposed between the core and the inner surfaces of the shells in the assembled reactor. Usually wire mesh of stainless steel is employed as the material of the buffer layer by reason of its adequate resilience, flexibility, resistance to exhaust heat and suitability to constitute a buffer layer which does not allow a free passage of gas therethrough. Though the core in the assembled housing is clamped by the two shells because of the buffer layer being compacted upon coupling of the two shells, there is still a possibility that the core makes an axial movement during use of the reactor. Accordingly it is a usual way that the housing has in its interior ring-like retainers located at fore- and aft-boundaries of its mid-portion to hold the catalytic core securely in the axial direction. However, this makes the construction of the reactor very complicated and inevitably raises the cost of the reactor production.

SUMMARY OF THE INVENTION

It is an object of the present invention to provide an improved catalytic reactor for use in automotive exhaust lines, which reactor features that its housing is simple in construction but nevertheless is sufficient in its rigidity and endurance to shocks and vibrations.

It is another object of the invention to provide an improved catalytic reactor of the described use, which reactor has a monolithic core treated with a catalyst and confined in a tubular housing and features a very simple and effective method of holding the core immovable.

It is a still another object of the invention to provide a method of producing a catalytic reactor according to the invention.

A catalytic reactor according to the invention has a tubular housing having an inlet at one end and an outlet at the other end, a catalytic means confined in a mid-portion of the housing such that fore- and aft-portions of the housing are both left vacant, and a resilient and flexible buffer means such as a layer of wire mesh for isolating the catalytic means from the inner surface of the housing. The reactor is characterized primarily in that the housing is made up of a pair of shells each consisting of a fore-portion, a mid-portion and an aft-portion respectively so shaped as to give the housing when the two shells are assembled together along a plane in which is contained the longitudinal axis of the housing, that each shell has two side flanges extending outwards along the aforementioned plane substantially over the entire length of the shell, that the width of each side flange becomes larger both in the fore- and aft-portions of the shell than in the mid-portion and that a coupling flange is attached to each end portion of the paired shells by welding the coupling flange both to an endmost region of the paired shells and to the end faces of the side flanges.

Preferably, the housing, i.e. the shells, is shaped such that the fore-portion diverges towards the mid-portion while the aft-portion converges from the mid-portion, and a plurality of parallel and spaced corrugations are formed in the mid-portion of each shell each to extend along a plane normal to the longitudinal axis of the housing and terminate at a short distance from each of the two side flanges.

This reactor is particularly suitable when the catalytic means is a monolithic and porous core such as a honeycomb core which is treated with a catalytic material. In this case the core is made to have a cross-sectional shape (e.g. a generally elliptical shape) generally similar to the cross-sectional shape of the mid-portion of the housing, and a layer of wire mesh covering the outer periphery of the core is utilized as the buffer means. When the reactor is assembled, the wire mesh buffer layer is pressed against the outer periphery of the core by the inner surfaces of the shells, and particularly by inwardly projecting portions of the aforementioned corrugations. To completely prevent an axial movement of the core in the housing, the shells are shaped such that two peripheral shoulders are formed in the inside of the housing respectively as fore- and aft-boundaries of the mid-portion of the housing, and the wire mesh layer is dimensioned such that two marginal regions thereof protrude respectively beyond the two end faces of the core and, upon assemblage of the reactor, are forced to be folded inwards along the respective edges of the core ends by the shoulders of the housing. In this connection, it is preferable that the two marginal regions of the wire mesh layer are more finely meshed than the remaining region of the same layer.

DESCRIPTION OF THE PREFERRED EMBODIMENTS

Figure 1:
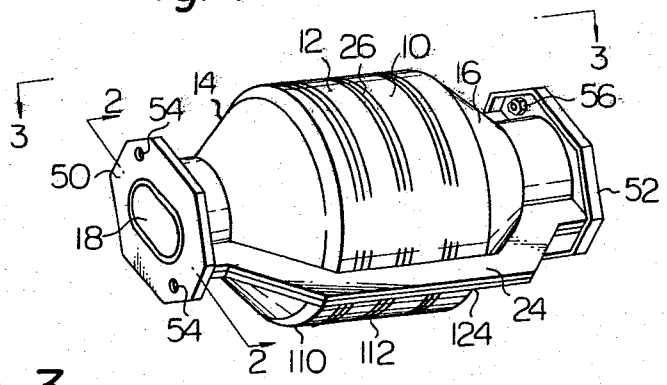
FIG. 1 is a perspective view of a catalytic reactor according to the invention.
Figure 3:
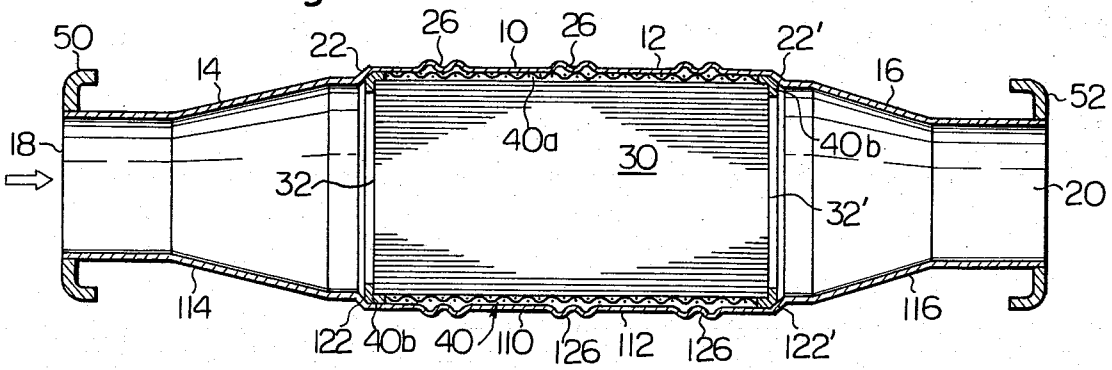
FIGS. 2 and 3 are sectional views respectively taken along the lines 2—2 and 3—3 of FIG. 1.
Figure 2:
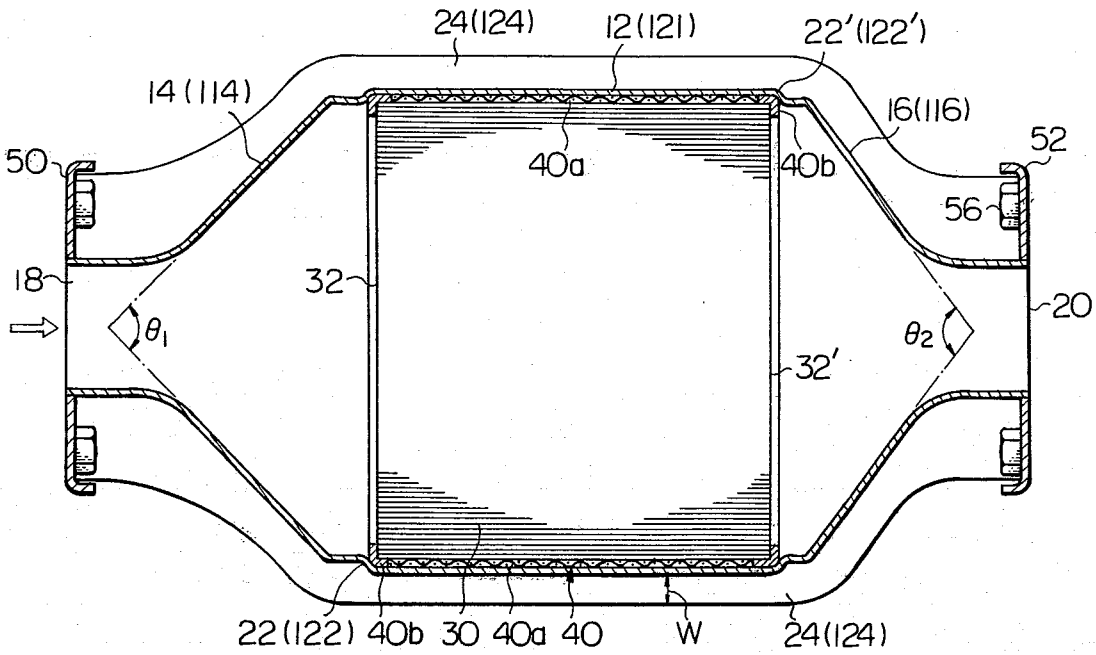

In a catalytic reactor of FIGS. 1–3, a tubular housing is made up of two identically shaped sheet metal shells, an upper shell 10 and a lower shell 110, flanged and welded tightly together along a mid-plane containing the longitudinal axis of the housing. The cross-sectional shape of this housing is generally elliptical with the major transverse axis contained in the aforementioned mid-plane. The material of the shells 10 and 110 is a heat- and corrosion-resistant alloy sheet such as a 13% Cr stainless steel sheet, for example, 1.5 mm in thickness, and each shell is a one-piece member produced from a single sheet of the alloy. The cross-sectional area of each shell 10(110) is not uniform over its entire length but is made largest in a mid-portion 12(112) to enclose therein a catalyst-treated monolithic carrier or core 30, which is generally elliptical in cross-section. The core 30 is a conventional one and carries a conventional catalyst. Each shell 10(110) has a fore-portion or inlet portion 14(114) divergently extending from the inlet 18 of the housing to the mid-portion 12(112) and an aft-portion or outlet portion 16(116) converging from the mid-portion 12(112) towards the outlet 20 of the housing. A boundary region between the mid-portion 12(112) and the inlet portion 14(114) is so shaped as to give a shoulder 22(122). Similarly, a boundary region between the mid-portion 12(112) and the outlet portion 16(116) gives a shoulder 22'(122').

Each side edge region of each shell 10(110) is so shaped as to give a flange 24(124) over the entire length of the shell 10(110). These flanges 24(124) lie in a plane parallel to the longitudinal axis of the shell 10(110) and normal to the minor axis of the semi-elliptical cross-section of the shell 10(110). As seen in FIG. 2, the width W of each of the flanges 24(124) is constant in the mid-portion 12(112) of the shell 10(110) but gradually becomes larger both in the inlet portion 14(114) and in the outlet portion 16(116) to achieve a maximum width at the inlet 18 and outlet 20 of the housing. The two shells 10 and 110 are secured together, after the installation of the catalyst support 30, by tightly welding the flanges 24 of the upper shell 10 to the corresponding flanges 124 of the lower shell 110.

A coupling flange 50 is secured to the thus assembled housing at its one end serving as the inlet 18 and another coupling flange 52 at the other end or outlet 20 for coupling of the reactor with exhaust pipes (not shown). Each of the coupling flanges 50, 52 has an aperture corresponding to the inlet 18 or outlet 20. The coupling flanges 50, 52 are fixed to the housing by welding in a state where the endmost portion of, for example, the inlet portion 14, 114 of the housing is engaged with the aperture of the flange 50. The welding is effected not only along the joints between the coupling flanges 50, 52 and the peripheral wall of the housing but also along the joints between the coupling flanges 50, 52 and the end faces of the side flanges 24, 124. To allow such a manner of welding, the side flanges 24 and 124 are made to terminate at a short distance (corresponding to the thickness of the coupling flanges 50, 52) from each end of the housing. Each coupling flange 50, 52 is produced by press-forming of a metal sheet and preferably is angled along its periphery towards the housing. Two or more bolt holes 54 are bored in each coupling flange 50, 52 at locations somewhat distant from the butt-jointed ends of the side flanges 24, 124, and a nut 56 for each bolt hole 54 is secured onto the inside (facing the housing) of each coupling flanges 50, 52.

As seen in FIGS. 1 and 3, a plurality of parallel and spaced ribs or corrugations 26(126) are formed on the peripheral wall of each shell 10(110) in its mid-portion 12(112) each to be contained in a plane serving as a cross-section of the housing and terminate at a short distance from each side flange 24(124). These corrugated ribs 26(126) enhance the rigidity of the housing and, besides, are effective for immovably holding the catalyst-treated core 30 in the housing as will be explained hereinafter. The height and depth of the corrugated ridges 26, 126 may be the same in all ridges but may alternatively made larger in some ridges 26, 126 formed in a middle region of the mid-portions 12, 112.

Figure 4:
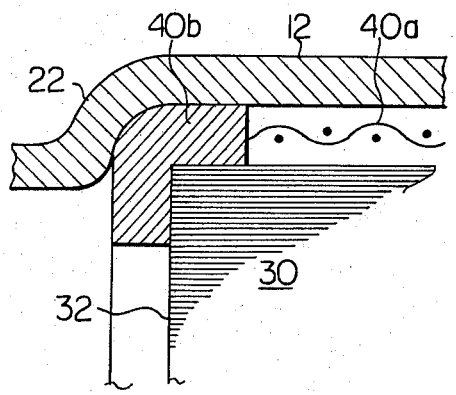
FIG. 4 is a partial enlargement of FIG. 3.

The monolithic core 30 is of a honeycomb structure by way of example, arranged to allow the exhaust gas to pass axially therethrough, i.e. from left to right in FIGS. 2 and 3. Of course the core 30 is treated with a suitable catalyst is advance, followed by curing. The core 30 has a generally elliptical cross-sectional shape transverse to the axial gas flow similar to but slightly smaller than the mid-portion of the housing defined by the mid-portions 12, 112 of the shells 10, 110. Also in length, the core 30 is slightly smaller than the mid-portion of the housing. Accordingly the interior of the mid-portion of the housing is almost entirely occupied by the catalytic core 30. As seen in FIGS. 3 and 4, a space between the elliptical periphery of the core 30 and the inside of the housing or shells 10, 110 is filled with a buffer layer 40 of wire mesh. It will be understood that the corrugations 26, 126 of the shells 10, 110 are effective for preventing an axial displacement of the buffer layer 40 and hence the core 30. The material of the buffer layer 40 should be resistant to heat and corrosion and suitably resilient, so that usually use is made of stainless steel. In elevational view of the reactor, the buffer layer 40 is slightly longer than the catalyst support 30 such that two end portions or marginal regions 40*b* of the buffer layer 40 respectively come into contact with the shoulder 22, 122 and the other shoulder 22' 122' of the housing and are forcibly folded along the periphery of the respective end faces 32, 32' of the core 30 towards the end faces 32 and 32'. As the result, an endmost region of each marginal region 40*b* covers a peripheral region of one end face 32 or 32' of the core 30.

To ensure that the marginal regions 40*b* of the buffer layer 40 are folded in the above described manner and somewhat squeezed during assemblage of the shells 10, 110 and the catalytic core 30 peripherally wrapped in the buffer layer 40, it is highly preferable that the marginal regions 40*b* are made to be more ductile than the remaining major portion 40*a* of the buffer layer 40. This is realizable by using a finer wire or fiber for the marginal regions 40*b* than that for the major portion 40*a* and affording a more tightly or finely meshed structure to the marginal regions 40*b* than to the major portion 40*a*. As a consequence, the marginal regions 40*b* will take the form of wire cloth rather than wire net. Though less tightly meshed, the major portion 40*a* of the wire mesh 40 is also made of considerably fine wires so as to have a satisfactory flexibility. It will be understood that the buffer layer 40 must serve as a retainer for the core 30 but is not required to serve as a gas passage: it is desired that the exhaust gas introduced into the catalytic reactor entirely passes through the core 30. Both in the major portion 40*a* and end portions 40*b*, the wire mesh 40 may have either a woven structure or a knit structure. In this case, the major portion 40*a* alone is prepared as a generally rectangular sheet while each marginal region 40*b* is prepared separately in the form of a belt or strip, and then each strip is stitched to the rectangular sheet by the use of a fine wire or metal fiber thread.

The width of the marginal regions 40*b* of the buffer layer 40 should not be made excessively large since, from the viewpoint of the efficiency of the reactor, it is undesirable to decrease an effective (uncovered) area of the end faces 32, 32' of the catalytic core 30.

The inlet portion 14, 114 and outlet portion 16, 116 of the housing are made divergent and convergent respectively, with the intention of effectively utilizing the entire cross-sectional area of the catalytic core 30. To minimize the total length and weight of the catalytic reactor, it is desirable that the inlet and outlet portions 14, 114 and 16, 116 are made as short as possible. The function and length of the inlet portion 14, 114 become well balanced when the divergence angle $\theta_1$ indicated in FIG. 2 is made about 90°. The convergence angle $\theta_2$ of the outlet portion 16, 116 would be made larger than the angle $\theta_1$: for example, $\theta_2$ will be made about 107° when $\theta_1$ is 90°.

Figure 5:
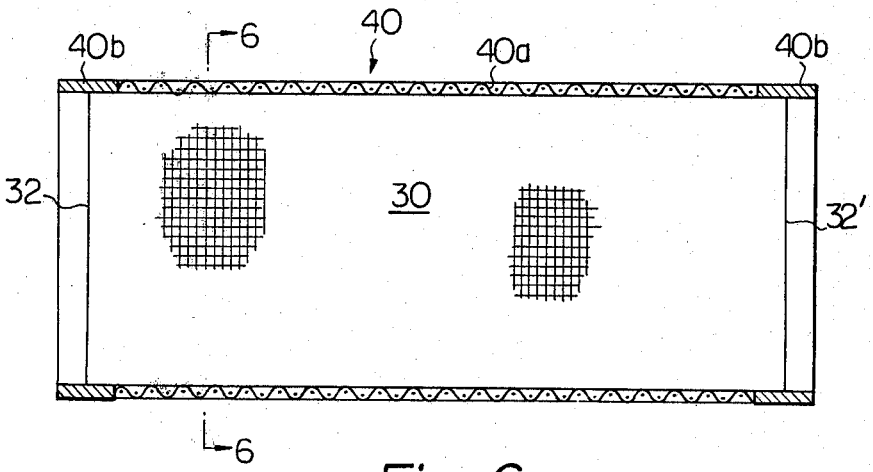
FIG. 5 is a transverse sectional view of a monolithic core treated with a catalyst and covered with a buffer layer prior to its installation in the reactor of FIG. 1.
Figure 6:
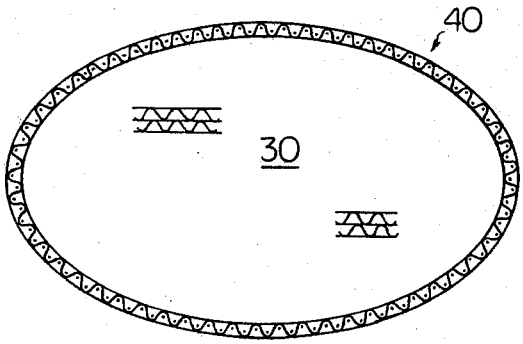
FIG. 6 is a cross-sectional view of the catalytic core of FIG. 5.

In assembly, the core 30, which has been treated with a catalyst and cured, is placed on a generally rectangular sheet of wire mesh (the initial state of the buffer layer 40) such that two parallel marginal regions (40*b*) of the sheet protrude beyond the end faces 32, 32' of the core 30. Then the wire mesh sheet is wrapped tightly around the elliptical periphery of the core 30 until the thickness of the wrapped sheet (40) becomes appropriate to fill the peripheral gap between the core 30 and the inside of the shells 10, 110. FIGS. 5 and 6 show the resultant subassembly of the core 30 and the wire mesh sheet, i.e. buffer layer 40. If necessary, loosening of the wrapped wire mesh sheet 40 may be prevented by stitching, binding, stapling or cementing.

As a modification of the above described procedure, the strips or marginal regions 40*b* of the buffer layer 40 may be left unjointed to the major portion 40*a*. In this case, first the major portion 40*a*of the buffer layer 40 alone is wrapped around the core 30 and then the marginal portions 40*b* are individually wrapped around the core 30 so as to adjoin the already wrapped major portion 40*a*. As a different modification which is suitable to industrial production, the buffer layer 40 may be prepared in a tubular form with an inner diameter adapted to the peripheral length of the core 30 prior to its assemblage with the core 30 so that the assemblage may be accomplished by inserting the core 30 into the tubular buffer layer. In this case the marginal portions 40*b* may be joined to the major portion before the tubing procedure, but it is more convenient to prepare the buffer layer 40 in three separate pieces, i.e. a tubular main portion 40*a* and two tubular or ring-like marginal portions 40*b*. Since the buffer layer 40 can be fixed upon assemblage of the two shells 10, 110, there is no need of joining the marginal portions 40*b* to the major portion 40*a* on the core 30.

The subassembly of the core 30 and the buffer layer 40 is placed in the mid-portion 112 of the lower shell 110, and then the upper shell 10 is assembled with the lower shell 110 so as to confine the subassembly in the mated two shells 10, 110. The assemblage of the two shells 10 and 110 is accomplished with some force in order that the side flanges 24 of the upper shell 10 come into close contact with the side flanges 124 of the lower shell 110, and the two shells 10, 110 are clamped in this state by a suitable means. The buffer layer 40, therefore, is compacted to a certain extent over the entire area and, furthermore, is locally squeezed by inwardly projected ridges of the corrugations 26, 126 of the two shells 10, 110. At the same time, an endmost portion (protruded from one end 32 or 32' of the core 30) of each marginal region 40*b* of the buffer layer 40 is pressed inwards by each shoulder 22, 122 or 22' 122', with the result that the protruded portion of each marginal region 40*b* is folded towards the end face 32 (or 32') along the edge of the end face 32 (or 32') as shown in FIG. 4. On account of these deformations of the buffer layer 40, the core 30 in the mated shells 10, 110 is prevented from moving either axially or laterally and well protected, particularly in its most fragile edge portions at the both ends, against shocks and vibrations during use of the catalytic reactor.

Then the side flanges 24 and 124 are welded to each other to provide a gas tight seal. At the welding, the presence of the corrugations 26, 126 prevents the shells 10, 110 from deforming by thermal expansion or retaining therein strains resulting from thermal stresses.

The catalytic reactor is completed by welding the two coupling flanges 50 and 52 to the assembled housing. As mentioned hereinbefore, the flanges 50, 52 are welded not only to the outer periphery of the shells 10, 110 but also to the fore- and aft-ends of the side flanges 24, 124.

A generally elliptical cross-sectional shape of the above described reactor is by way of example, though this shape is desirable in many cases. It is permissible that the invention is embodied into a catalytic reactor which is nearly circular or nearly rectagular in cross section.

Furthermore, it will be understood that the above described construction of the housing is applicable also to a catalytic reactor utilizing a catalyst in the form of pellets.

The reactor housing according to the invention is simple in construction and easy to assemble as will have been understood from the foregoing description. Nevertheless, this housing has a sufficiently high rigidity and can fully withstand shocks and vibrations it experiences on automobiles. The high rigidity of this housing originates primarily from its features that both the inlet portion 14, 114 and the outlet portion 16, 116 are integrated with the mid-portion 12, 112, that the side flanges 24, 124 of the shells 10, 110 extend continuously substantially over the entire length of the housing and that the width W of these flanges 24, 124 is enlarged in the inlet and outlet portions. The integration of the inlet and outlet portions with the mid-portion eliminates the need of peripheral joints such as welded joints which tend to become a weak-point of the housing. Owing to the enlargment of the width W of the side flanges 24, 124 in the inlet and outlet portions 14, 114; 16, 116, particularly a gradual enlargement from the mid-portion towards the inlet 18 and outlet 20, the inlet and outlet portions each become comparable in rigidity to a cylindrical tube of a relatively large wall thickness. The welding of the coupling flanges 50, 52 to the side flanges 24, 124 further enhances the rigidity of the inlet and outlet portions 14, 114; 16, 116 of the housing, while the corrugated ridges 26, 126 enhance the rigidity of the mid-portion 12, 112.

The housing, therefore, can firmly support the mass of the core 30 and protect the core 30 against breakage by, for example, vibrations transmitted through the exhaust pipe.

Another advantage of the catalytic reactor of the invention is that the catalytic core 30 is held securely in the housing by a simple means, i.e. only a resilient buffer layer 40. The provision of the wire mesh buffer layer 40 around the outer periphery of the catalytic core 30 as a filler for a gap between the core 30 and the inside periphery of the housing is a known technique. According to the invention, however, this buffer layer 40 is utilized also for supporting the core 30 in its axial direction by making the marginal regions **40*b* of the buffer layer 40 protrude beyond the end faces 32, 32' of the core 30 and forming the shoulders 22, 122 and 22', 122' at the fore- and aft-boundaries of the mid-portion 12, 112 of the housing. An axial displacement of the core 30 can be prevented completely by this method, though the peripheral clamping by means of the corrugated ridges 26, 126 serve the same purpose, too, without incorporating any extra parts such as a bracket into the housing. Besides, the folded marginal regions 40*b* of the buffer layer 40 afford an effective protection against damage to the edges and end faces 32, 32' of the core 30. The shoulders 22, 122 and 22', 122' make a considerable contribution to the enhancement of the physical strength of the housing and accordingly to the prevention of vibrations of the core 30 in addition to their principal role of axially supporting the subassembly of the core 30 and the buffer layer 40**.

These features and advantages of the invention are reflected into an improved durability of the catalytic reactor and reduced costs of the reactor production.

What is claimed is:

1. A catalytic reactor for treating exhaust gas of an automotive engine in an exhaust line for the engine, the reactor comprising:

a tubular housing having an inlet at one end thereof and an outlet at the other end thereof;

a monolithic and porous core treated with a catalytic material and confined in a mid-portion of said housing between a vacant fore-portion of said housing extending from said inlet to said mid-portion and diverging in longitudinal section toward said mid-portion and a vacant aft-portion of said housing extending from said mid-portion to said aft-portion, and converging in longitudinal section from said mid-portion, the angle of convergence of said aft-portion being greater than the angle of divergence of said fore-portion, said core having a cross-sectional shape generally similar to the cross-sectional shape of said mid-portion; and a buffer layer of wire mesh which covers the outer periphery of said core so as to be tightly interposed between said core and the inner surface of said housing;

said housing consisting of a pair of shells assembled together along a plane intersecting the longitudinal axis of said housing and two coupling flanges welded to said shells respectively at foremost and aftmost locations of said housing for coupling of the reactor with other tubular components of the exhaust line, each of said shells being a one-piece member having two side flanges extending outwards along said plane substantially over the entire length of each shell such that said housing is integrated by welding said side flanges of one shell to the corresponding side flanges of the other shell and welding each of said coupling flanges both to the peripheral surfaces of endmost regions of said shells and to end faces of said side flanges, the width of each of said side flanges becoming gradually larger both in said fore-portion and in said aft-portion than in said mid-portion and terminating in a maximum width at both the fore-end and aft-end of each side flange, each of said coupling flanges being provided with at least two bolt holes outwardly spaced from the welded portions of said coupling flanges with said fore and aft portions of said housing and in a plane distant from the plane of said side flanges, said shells being shaped so as to form two peripheral shoulders in the inside of said housing respectively at fore- and aft- boundaries of said mid-portion and having a plurality of parallel and spaced circumferential corrugations formed in a mid-region of said mid-portion of said housing each terminating at a short distance from each of said side flanges, whereby said buffer layer is pressed against the outer periphery of said core by inwardly projected portions of said corrugations, said buffer layer consisting of a central major region and two marginal regions which are formed of a wire finer than the wire used as the material of said central major region so as to become more ductile than said central major region and more finely meshed than said central major region and respectively protrude beyond end faces of said core such that the protruded portion of each of said marginal regions is forced to be folded inwardly along the edge of one end of said core by contact with one of said two peripheral shoulders whereby axial movement of said core is precluded.

2. A catalytic reactor according to claim 1, wherein said marginal regions of said buffer layer are each prepared separately from said remaining region and joined to said remaining major region by stitching.

3. A catalytic converter according to claim 1, wherein the cross-section shape of said mid-portion is generally elliptical.

4. A catalytic reactor according to claim 1, wherein said marginal regions of said buffer layer are each prepared separately from said remaining region and left unjointed to said remaining region.

5. A catalytic reactor according to claim 4, wherein said marginal regions and said remaining region of said buffer layer each take a tubular form.

* * * * *